United States Patent [19]

Jackson et al.

[11] 4,169,446

[45] Oct. 2, 1979

[54] CDI METHOD AND SYSTEM WITH IN PHASE COILS

[75] Inventors: Robert V. Jackson, Los Angeles, Calif.; Harold F. Anderson, deceased, late of Squaw Valley, Calif.

[73] Assignee: McCulloch Corporation, Los Angeles, Calif.

[21] Appl. No.: 615,514

[22] Filed: Sep. 22, 1975

[51] Int. Cl.[2] ..... F02P 1/00

[52] U.S. Cl. ..... 123/148 CC

[58] Field of Search ..... 123/148 CC, 148 CB; 315/209 CD; 310/70 R, 70 A

[56] References Cited

U.S. PATENT DOCUMENTS

| | | | |
|---|---|---|---|
| 3,500,809 | 3/1970 | Hohne et al. | 123/148 CC |
| 3,515,109 | 6/1970 | Farr | 123/148 CC |
| 3,722,488 | 3/1973 | Swift | 123/148 CC |
| 3,729,647 | 4/1973 | Mainprize | 123/148 CC |
| 3,805,759 | 4/1974 | Fitzner | 123/148 CC |
| 3,871,348 | 3/1975 | Cauil | 123/148 CC |
| 3,894,524 | 7/1975 | Burkett | 123/148 CC |
| 3,937,200 | 2/1976 | Sceder | 123/148 CC |

OTHER PUBLICATIONS

"Breakerless High Frequency Ignition System," by McClelland, Zoll, SAE Journal, 7/63, pp. 74–77.

*Primary Examiner*—Ronald B. Cox

*Attorney, Agent, or Firm*—Burns, Doane, Swecker & Mathis

[57] ABSTRACT

A capacitor discharge ignition system employing in-phase trigger, charge and shut-off coils, in a circuit which provides force commutation of the electronic switch and which provides compensation for variations in temperature, inhibition of extraneous triggering of the electronic switch and selective system shut-off. Extraneous triggering may be inhibited by the biasing of the electronic switch as a function of the polarity of the waveforms as well as by the damping of the transient which occurs at the end of the charge of the ignition capacitor. Shut-off is achieved by the shorting of the trigger coil which loads the charge coil to protect the ignition capacitor. Additional protection is provided by the selective shorting of the shut-off coil. Gate protection for the electronic switch is provided by the clamping of the cathode to gate potential.

25 Claims, 4 Drawing Figures

CDI METHOD AND SYSTEM WITH IN PHASE COILS

BACKGROUND OF THE INVENTION

The present invention is directed to a capacitor discharge ignition system having in-phase charge, trigger and shut-off coils. In addition, the system may provide force commutation of the electronic switch, independent variation of three triggering circuit characteristics dependent on the selection of component value, compensation for temperature variations, inhibition of extraneous gating of the electronic switch, and engine shut-off.

Capacitor discharge ignition systems are well known in which a flywheel magnet is rotated into and out of flux cutting proximity to one coil effecting charging of an ignition capacitor and to another coil for effecting the triggering of an electronic switch discharging the ignition capacitor through a high voltage transformer to a gap ignition device of the engine. The necessary temporal displacement between the charging of the ignition capacitor and the triggering of the electronic switch is generally achieved by the physical displacement of the charge and trigger coils, or the winding thereof in opposite directions to provide out-of-phase waveforms. Since space is at a premium in many applications, the physical displacement of the coils may be unsatisfactory and the winding of out-of-phase coils generally includes additional manufacturing steps.

It is accordingly an object of the present invention to provide a novel method and capacitor discharge ignition circuit which utilized inphase trigger and charge coils wound on the same core in the same direction to reduce manufacturing steps.

The problem of false gating, i.e., gating at undesirable times as a result of transients such as exist upon the cessation of the charge coil waveform, has typically been addressed by the utilization of a capacitor which absorbed the transients and therefore isolated the gate electrode therefrom. However, the use of an expensive capacitor for this purpose also results in the absorption of power from the trigger coil necessitating the use of a larger trigger coil.

It is another object of the present invention to provide a novel method and capacitor discharge ignition circuit which reduces false gating in response to transients without an increased trigger coil power output requirement through the utilization of a more stable and less expensive triggering and bias circuit for the electronic switch.

Capacitor discharge ignition circuits find many applications in hostile environments such as in construction sites and in logging operations where they are often exposed to a wide range of ambient temperature as well as the heat generated by the widely varying loads on the engines with which they are associated. The holding current, i.e., that required to maintain switch conduction, and the sensitivity of the switch are generally independently responsive to such changes in temperature.

It is still another object of the present invention to provide a novel method and capacitor discharge ignition circuit having improved temperature stability while achieving improved design flexibility by maintaining independent control over gate sensitivity, gate current and the degree of back bias of the electronic switch.

Conventional capacitor discharge ignition systems may employ a manual shut-off switch to ground the connection between the trigger coil and the gate electrode of the electronic switch to prevent discharge of the ignition capacitor. A potential consequence of this shut-off method is, as a result of the continued rotation of the flywheel magnet in proximity of the charge coil due to the inertia of the engine, a continued build-up of the charge on the ignition capacitor to a voltage sufficient to cause breakdown of the capacitor or of the electronic switch. An alternative known method involves the shorting of the charge coil by a manually operable switch. However, a significant potential of arcing occurs.

It is a further object of the present invention to provide a novel method and capacitor discharge ignition circuit which achieves engine shut-off by shorting the trigger coil while at the same time reducing the charge coil potential by loading the core and thus limiting the magnitude of the charge which accumulates on the ignition capacitor.

Capacitor discharge ignition systems have achieved force commutation of the electronic switch by means of the spark current. However, such a design requires that only a single pulse, unidirectional spark current be employed.

It is yet another object of the present invention to provide a novel method and capacitor discharge ignition circuit which achieves force commutation with a multiple pulse, bidirectional spark.

Heavily loaded trigger circuits are known to be advantageous because of temperature stability, transient suppression, etc. but excessive current results at high engine speed to the detriment of the expensive electronic switch.

It is yet still another object of the present invention to provide a novel method and capacitor discharge ignition circuit which provides protection for the electronic switch despite wide variations in the generated trigger circuit power as a result of engine speed.

These and many other objects of the present invention will become apparent to one skilled in the art to which the invention pertains from a perusal of the following detailed description when read in conjuction with the appended drawings.

THE DRAWINGS

FIG. 1 is a schematic circuit diagram of the circuit of the present invention illustrating certain current paths;

FIGS. 2(*a*) and 2(*b*) are illustrations of the waveforms generated by the charge coil and trigger coil of the present invention;

FIGS. 3(*a*) through (*f*) are illustrations of waveforms generated at various points in the circuit of the present invention; and, FIG. 4 is a schematic circuit diagram of a second embodiment of a triggering and shut-off subcircuit which may be employed in the circuit illustrated in FIG. 1.

DETAILED DESCRIPTION

To facilitate an understanding of the circuit of the present invention and the various functions performed thereby, reference may be had to the following detailed description of the circuit and its operation in performing the various functions.

THE CIRCUIT

Figure 1:
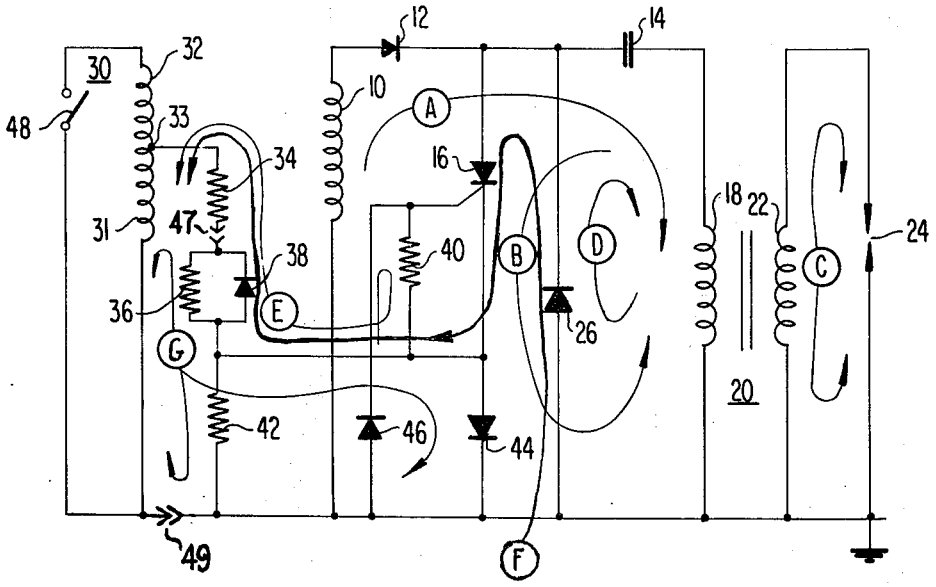

Referring first to FIG. 1 where a capacitor discharge ignition circuit is illustrated as including a charge coil 10 formed, for example, of 2,500 turns of No. 36 wire and connected in a circuit including a diode 12, an ignition capacitor 14, and the primary winding 18 of a high voltage transformer 20. Rotation of a flywheel magnet of the engine (not shown) into and out of flux cutting proximity to the charge coil 10 operates in the conventional manner to induce a voltage in the coil 10 having a waveform as generally depicted in FIG. 2(*a*).

Figure 2:
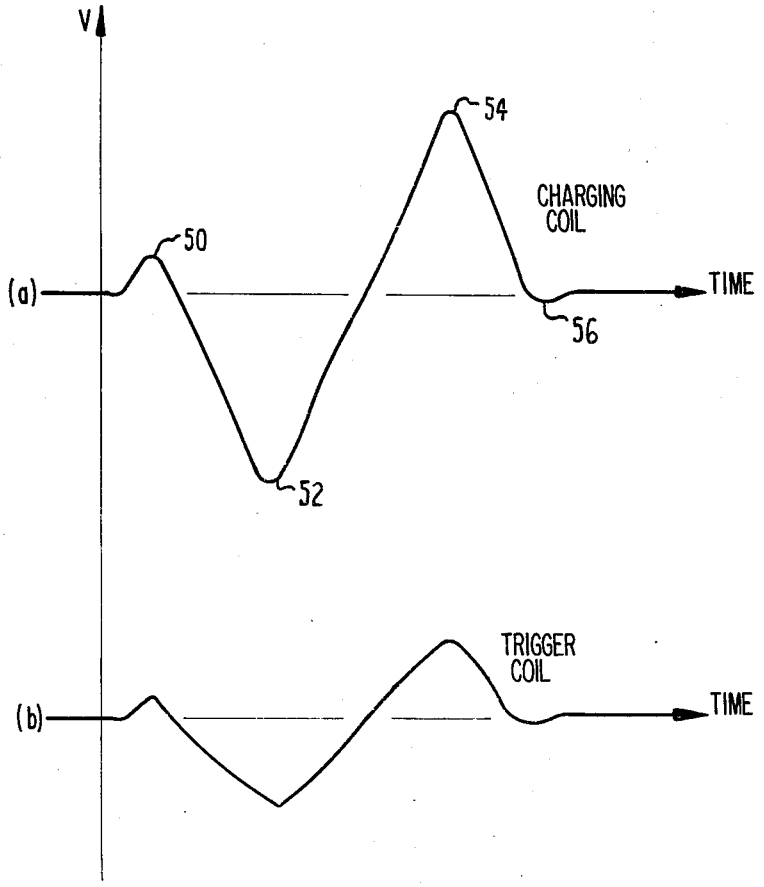

As illustrated in FIG. 2(*a*), the charge coil waveform may comprise a relatively small positive portion 50, a larger negative portion 52, a large positive portion 54, and a relatively small negative portion 56. The current generated responsively to the voltage of the positive portions of the waveform illustrated in FIG. 2(*a*) will be passed through the diode 12 to effect charging of the capacitor 14 to ignition potential. The path of conventional current associated with the above-mentioned charging of the capacitor 14 is denoted by the letter "A" in FIG. 1. The diode 12 will block the passing of the current induced by the voltage of the negative portions of the charge coil waveform illustrated in FIG. 2(*a*).

With continued reference to FIG. 1, the ignition capacitor 14 is connected in a discharge circuit including the primary winding 18 of the transformer 20 and an electronic switch such as the illustrated SCR 16. It should be understood, however, that any switch capable of being electronically triggered may be substituted therefor with appropriate changes in the polarities of the several biasing diodes associated with the switch and appropriate changes in the polarities of waveforms applied to the switch. In the case of the SCR 16, it may be triggered into conduction by the application of a positive gate-to-cathode potential at any time that the SCR has a positive anode-to-cathode bias.

When triggered into conduction, the SCR 16 will effect the discharge of the capacitor 14 through the primary winding 18 of the transformer 20 as illustrated in FIG. 1 by a current path denoted by the letter "B". The primary winding 18 of transformer 20 may comprise 100 turns of No. 26 wire and the secondary winding 22 of the transformer 20 may comprise 7,000 turns of No. 44 wire. It will be apparent that the discharge of capacitor 14 through primary winding 18 will be inductively coupled by the secondary winding 22 of transformer 20 to a conventional ionization discharge device such as spark plug 24. The potential developed across the secondary winding 22 may serve as a gap ionizing potential applied to spark plug 24 for engine ignition.

Current resulting from firing the spark plug 24 may flow as indicated by current path "C" with the particular direction of flow depending on the orientation of secondary winding 22 with respect to primary winding 18. The discharge of capacitor 14 may serve to temporarily store energy in the magnetic field established in transformer 20 by current passage through the primary winding 18. As that magnetic field collapses upon the cessation of current, a current path denoted by the letter "C" in FIG. 1 may be established through a diode 26 and the capacitor 14 to effect a partial recharging of the capacitor 14 and, at the same time, causing the spark plug 24 to arc in the reverse direction. With the trigger potential remaining on the SCR gate electrode, the SCR 16 will again be triggered into conduction to once more effect the discharge of the capacitor 14 through the primary winding 18 of transformer 20 to again reverse the polarity of the arc of the spark plug 24. This process will continue in the presence of a triggering potential until the charge on capacitor 14 has been dissipated and has been found to produce about four or five closely spaced arcs.

Figure 3:
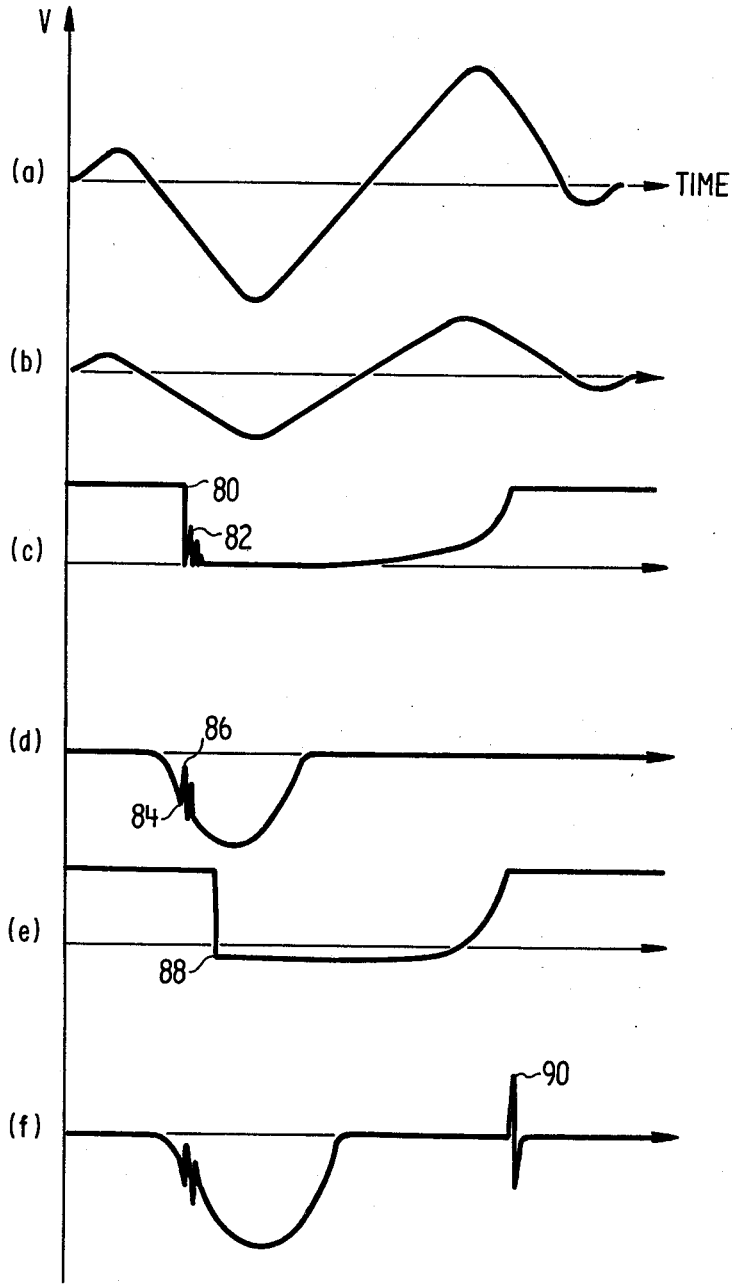

The charging sequence of the circuit of the present invention is illustrated graphically in the timing diagram of FIG. 3. FIGS. 3(*a*) and 4(*b*) depict the charging coil and trigger coil waveforms discussed below in connection with FIG. 2. FIGS. 3(*c*) through 3(*f*) depict voltage waveforms measured at various points in the circuit with FIG. 3(*c*) illustrating the voltage appearing across the capacitor 14. At the point on the waveform designated "80", an initial discharging of the capacitor has been induced by the negative swing in the trigger coil waveform. Voltage oscillations 82 represent the "ringing" induced in the circuit by the repeated sequential chargings and dischargings of the capacitor 14.

Referring once again to FIG. 1, a control coil 30 may be coaxially wound with the charge coil 10 may be tapped to provide a trigger coil 31 and shut-off coil 32. The trigger coil 31 may be formed of 100 turns of No. 36 wire and the shut-off coil formed of 200 turns of No. 36 wire. Voltages may be induced in coils 31 and 32 by the passage of the flywheel magnet (not shown) into and out of flux cutting proximity with the control coil 30. The windings of the coils 10 and 30 are so oriented that the open circuit output waveform of trigger coil 31 and the waveform of charge coil 10 are substantially in phase with one another. The phase relationship of the trigger coil and charge coil waveforms is depicted in FIG. 2, wherein the output waveform of the trigger coil 31 measured from the center tap to ground appears as is illustrated in FIG. 2(*b*). From a comparison of FIG. 2(*a*) with FIG. 2(*b*) it may be observed that the voltage waveforms are substantially identical in shape and differ only in amplitude as a function of the number of turns and impedance of the coils.

The trigger coil 31 is connected to the gate electrode of SCR 16 by the novel circuit of the present invention. The finish end of the trigger coil 31 may be connected to the cathode of the SCR 16 by way of a resistor 34 in series with the parallel combination of a resistor 36 and a diode 38. The cathode of the SCR 16 may be connected to the gate of the SCR 16 through a resistor 40 and to ground through the parallel combination of a resistor 42 and a diode 44. The gate of the SCR 16 may be grounded by a diode 46. The finish end of the trigger coil 31 is connected at the tap 33 to the start end of the shut-off coil 32 and the finish end of the trigger coil 31 may be grounded by the rounding of the finish end of the shut-off coil 32 through a conventional manually operable switch 48.

The circuit illustrated schematically in FIG. 1 employs a triggering and shut-off subcircuit comprised of the control coil 30, the resistor 34 and the conventional switch 48. For purposes of illustration, the triggering and shut-off subcircuit is depicted as being connected to the remaining circuitry by junctions 47 and 49.

Figure 4:
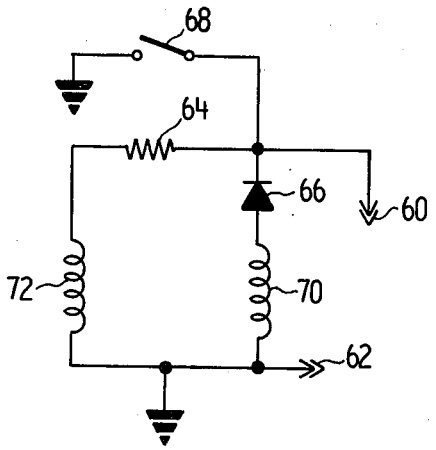

Referring now to FIG. 4, a schematic circuit diagram of a second embodiment of the triggering and shut-off subcircuit of the present invention is illustrated. The subcircuit of FIG. 4 may be attached to FIG. 1 by electrically connecting junctions 60 and 62 of the circuit of FIG. 4 with junctions 47 and 49, respectively, of the circuit of FIG. 1.

Again referring to FIG. 4, the junction 60 may be connected to a resistor 64 and the cathode of a diode 66. The junction 60 may be selectively grounded by a conventional, manually operable switch 68. The anode of the diode 66 may be connected to the finish end of a shut-off coil 70. Advantageously, the shut-off coil may be formed of 100 turns of #30 wire. Resistor 64 may be connected to the finish end of a trigger coil 72. Advantageously, the trigger coil may be formed of 100 turns of #30 wire. The start ends of the coils 70 and 72 may be grounded by connection to junction 62. Voltages may be induced in the coils 70 and 72 by the passage of the flywheel magnet (not shown) into and out of flux cutting proximity with the coils. coils 70 and 72 may be so oriented with respect to one another and to charging coil 10 of FIG. 1, that the output waveforms with respect to ground of all three coils are substantially in phase. This effect may be achieved by winding the coils 70, 72 and 10 on the same core so that the coils are positively inductively coupled.

With reference again to FIG. 1, a gating current path denoted by the letter "E" is established for the negative portion of the trigger coil waveform induced from ground potential (i.e., the start end of the coil 31 or coil 72 of FIG. 4) through the diode 46, the resistor 40, the diode 38, the junction 47 and the triggering and shut-off subcircuit. It will be apparent that when a negative voltage with respect to ground is induced at the junction 47, the cathode of the SCR 16 will be held negative with respect to the gate due to conduction of the diode 46 whereby the gating of the SCR 16 may be effected. FIG. 3(*d*) illustrates the cathode-to-gate voltage which reaches the minimum value necessary to trigger the SCR 16 into conduction at the point 84 on the waveform. The positive going spikes 86 in the waveform of FIG. 3(*d*) reflect the repeated swamping of the cathode potential imposed by the trigger coil waveform due to a positive forward voltage developed across the diode 44 when current flows along path "B".

With reference once more to FIG. 1, the negative component of the trigger coil waveform may tend to establish a flow of conventonal current along the path designated by the letter "F". As will hereinafter appear, this current flow tends to force commutate the SCR 16.

When a positive voltage with respect to ground is induced at the junction 47 during the positive portion of the induced waveform of FIG. 2(*b*) it will be apparent that the resistors 36 and 42 act as a voltage divider which will impose a positive voltage on the cathode of the SCR 16 to prevent the conduction thereof. The current path so established in denoted by the letter "G" in FIG. 1.

FORCE COMMUTATION

It is important that conduction of the SCR 16 be interrupted after firing since the current normally utilized to charge the capacitor 14 will otherwise be shunted to ground through the SCT 16 and the diode 44. A negative cathode-to-gate voltage on the SCR applied at the junction 47 by the trigger coil will serve to gate the SCR 16 into conduction and to develop a voltage drop across the diode 44 due to the forward resistance thereof. The voltage drop developed across diode 44 raises the voltage at the cathode of the SCR 16 and swamps the negative gating voltage provided by trigger coil 31. As a result, the conduction of the SCR 16 immediately serves to back bias the diode 46 out of conduction and to thereby remove the negative cathode-to-gate bias until the capacitor is discharged. The relationship between the capacitor voltage and the cathode-to-gate voltage is illustrated in FIGS. 4(*c*) and 4(*d*).

When the charge on the capacitor 14 is reduced below that value which effects back biasing of the diode 46, a negative cathode-to-gate potential may again be imposed by the negative component of the trigger coil waveform. The SCR may remain conductive permitting current flow along the conventional current path denoted by the letter "F". This latter current path pulls the SCR anode negative and reverses the charge on the ignition capacitor. This removes the positive anode-to-cathode SCR bias and force commutates the SCR out of conduction. The effects on the anode potential due to the current flow along path "F" are illustrated in FIG. 3(*e*) by the small negative voltage 88 appearing at the anode after discharge of the capacitor. This small negative voltage may operate to place a slight reverse charge on the capacitor.

GATE BIAS PROTECTION

The continued presence of the negative voltage component of the trigger coil on the SCR cathode after discharge of the capacitor may not produce an excessive gate-to-cathode current in the circuit of the present invention. The SCR gate voltage is the voltage drop across the diode 46 and the SCR cathode voltage is the drop across the diode 26 and the SCR anode-to-cathode junction. The maximum forward voltage which may appear across th diodes 46 and 26 will be nearly the same and will in any event, be limited to approximatey 1 volt depending on the composition of the semi-conductor material out of which the diodes are constructed. Thus the maximum gate-to-cathode potential is limited, approximately to the forward voltage across the SCR from anode-to-cathode. This voltage drop will be insufficient to damage the SCR when applied gate-to-cathode.

CIRCUIT TEMPERATURE STABILITY

It is known in the art that both the triggering requirements of an SCR and the anode-to-cathode holding current are dependent on the temperature of the device junctions. It is desirable to compensate for these temperature variations to provide ignition sparks of uniform timing and duration through a broad range of ambient temperatures.

The biasing and interconnection of SCR 16 and diode 44 in the present invention may provide improved circuit stability over wide variation in ambient temperature. The forward resistance across diode 44 remains relatively stable as temperature increases when compared to the forward resistance of the SCR 16. The amount of current flowing through the series combination of the SCR 16 and the diode 44 will depend on the sum of the forwad resistances presented by the device. The thermal stability of the forward resistance of diode 44 renders the series resistance of the combination more stable. As a result the voltage required to maintain the holding current through the SCR tends to remain constant.

Temperature compensation of the gate signal to SCR 16 may be obtained by the selection of trigger circuit parameters to cause the impedance of the trigger signal source, i.e., trigger coil 31, resistor 34 and resistor 42, to increase with increasing temperature and thereby reduce the gate current in accordance with the reduced gate current requirement of SCR 16 with increasing temperature. Hence, the conduction of the SCR can be made quite stable over a wide range of temperature changes.

The temperature stability of the circuit is also greatly enhanced by the gate-to-cathode resistor 40. The selection of the value of the resistance of the external resistor 40 several orders of magnitude below that of the internal resistance of the SCR insures that most of the current will flow through the resistor 40. The impedance of the external resistor 40 is relatively constant with respect to changes in temperature while the internal impedance of the SCR changes nonlinearly with variations in temperature.

GATE SENSITIVITY

With continued reference to FIG. 1, the trigger coil waveform and the circuit connecting the coil to the gate and cathode of SCR 16 are operative to inhibit triggering of the SCR 16 during the charging of the capacitor 14. This is a desirable result, since triggering of the SCR 16 during capacitor charging could prevent proper charging of the capacitor 14 and could discharge the gap ionization device 24 at an incorrect time in a combustion cycle of the engine for which the circuit provides an ignition spark.

With reference also to FIG. 2 as previously noted, the positive voltage component 54 of the charge coil waveform depicted in FIG. 2(*a*) is applied to the capacitor 14 through the diode 12. A positive waveform component 60 of the trigger coil waveform depicted in FIG. 2(*b*) appears at the tap 33 substantially in phase with positive charging component 54 of the charge coil waveform. This positive waveform component 54 of the trigger coil waveform results in a current along the current path denoted by the letter "G" in FIG. 1. Due to the forward resistance of the diode 44, this current flow tends to hold the cathode of the SCR 16 at a positive voltage with respect to ground. Since no current flows through the back biased diode 46, the gate and cathode of the SCR are held at essentially the same positive voltage by the absence of current through the resistor 40. The value of the current along path "G" and the degree of back bias of the diode 46 is controllable by the selection of the value of the resistor 36. The resistor 36 also suppresses the end of charging current transient and substantially diminishes the undesired triggering of the SCR.

Referring to FIG. 3, the cathode-to-gate voltage waveform is illustrated for the circuit of the present invention in FIG. 3(*d*). FIG. 3(*f*) illustrates the cathode-to-gate waveform for the circuit of the present invention where the resistor 36 has been eliminated. A transient spike, denoted by the numeral 90, is caused by back emf occurring at the end of charging of the capacitor 14. The transient spike 90 may be sufficient to cause extraneous triggering at an incorrect time in the combustion cycle of the engine. As may be noted with reference to FIG. 3(*d*), the back emf transient is completely damped out in the circuit of the present invention incorporating the resistor 36.

Referring once more to FIG. 2(*b*), it may be noted that the positive waveform component 60 of the trigger coil depicted in FIG. 2(*b*) is preceded by the negative waveform component 58 of the trigger coil waveform. As discussed above, triggering of the SCR 16 induced by the appearance of negative voltage component 58 at tap 33 of the trigger coil.

ENGINE SHUT-OFF

With reference to FIG. 1, the operation of the circuit heretofore described has assumed a condition in which the contacts of the manually operable switch 48 have remained in an open condition. The closure of the contacts of switch 48 by the operator will insure engine shut-off.

As discussed above, the circuit of the present invention may include a shut-off coil 32 connected in series with the trigger coil 31 and disposed in flux cutting proximity to a flywheel magnet of the engine. The shut-off coil 32 may be operable to reduce the magnetic flux in proximity of the trigger coil 31 when the series combination of the two coils is shorted by means of the switch 48. Where the shut-off coil and trigger coil are positively inductively coupled, i.e., where the fluxes in the coils tend to reinforce one another, the shorting of the series combination of the two coils loads the cores of the coils and inhibits generation of the trigger coil waveform. The shut-off coil and trigger coil may be positively inductively coupled by being wound in the same direction about a common core and may be portions of the same coil as earlier described.

The shorting of the shut-off coil or the series combination of the shut-off coil and trigger coil also loads the core for the charge coil and reduces the amplitude of the capacitor charging waveform. Thus, closing of the switch 48 inhibits the gating of the electronic switch 16 and, at the same time, prevent overcharging of capacitor 14 and overloading of electronic switch 16 by the loading of the core shared with the charge coil.

With reference to FIG. 4, the functioning of an alternate triggering and shut-off subcircuit will be described. Where the subcircuit of FIG. 4 is connected to the gating circuitry of FIG. 1 in place of the triggering and shut-off subcircuit of FIG. 1, the manually operable switch 68 is in an open position during engine operation. The closure of the switch 68 by the operator will insure engine shut-off.

As discussed above, the triggering and shut-off subcircuit of FIG. 4 may include the trigger coil 72 and the shut-off coil 70, connected in series and positively inductively coupled with each other and with the charging coil 10. During engine operation, the negative component of the trigger coil waveform is delivered to the gating circuitry through the resistor 64. The negative component of the shut-off coil waveform is blocked by the diode 66. The positive components of both the triggering coil and shut-off coil reinforce one another and tend to hold the cathode of the SCR 16 at a positive voltage with respect to ground, thus inhibiting undesired triggering of the SCR during the charging of the capacitor 14.

Closure of the manually operable switch 68 grounds the outputs of both the trigger coil and the shut-off coil. Thus no negative gating pulse is applied to the cathode of the SCR and consequently, engine ignition will cease. However, subsequent charging waveforms continue to be generated by the charging coil 10 as the engine coasts to a stop. Because the trigger and shut-off coils are inductively coupled to the charging coil, the output of the charging coil is inhibited by the loading of the core shared by the coils. In this way, overcharging of capacitor 14 is prevented.

INDEPENDENTLY VARIABLE CONTROLS

A significant advantage of the present circuit is the independence of the gate sensitivity (as provided by the resistor 40), gate current (as provided by the resistor 34 or resistor 64 of the embodiment of FIG. 4) and the degree of back bias controls (as provided by the resistor 36). In addition, the value of the resistor 42 independently determines the voltage picked off of the voltage divider network and thus the point in the magnetic cycle at which the threshold voltage of the SCR is reached. Gate noise is also minimized by the resistor 42 and the stability of the SCR is improved by the ground connection established therethrough. The value of resistor 42 may be selected to fix the minimum engine speed at which triggering of the SCR will occur. The values of each of these components may be selectively varied to vary one circuit operating parameter without affecting the other operating parameters of the circuit.

CIRCUIT VALUES

In the exemplary circuit of FIG. 1, the values of the various circuit components may be as follows:

| | |
|---|---|
| SCR 16 | G.E. No. C1'06D |
| Resistor 34 | 10 ohms, 0.5 watt |
| Resistor 36 | 100 ohms, 0.25 watt |
| Resistors 40 and 42 | 18 ohms, 0.25 watt |
| Capacitor 14 | 0.68 microfarads |
| Diodes 38, 44 and 46 | GI No. G1B |
| Diode 26 | GI No. G1H |
| Diode 12 | GI No. HG4, 6v. |

In the exemplary circuit of FIG. 4, the values of the various circuit components may be as follows:

| | |
|---|---|
| Resistor 64 | 18 ohms, 0.5 watt |
| Diode 66 | GI No. G1B |

ADVANTAGES AND SCOPE OF THE INVENTION

As has been explained in connection with the exemplary circuit of FIG. 1, the present invention provides force commutation subsequent to the complete discharge of the ignition capacitor. The commutation is induced by the control signal provided by the triggering coil.

In addition, the circuit provides gate bias protection by limiting the voltage drop between the control and output electrodes of the electronic switch during the application of the triggering wave component of the control signal to the electronic switch.

Further, the circuit provides operating stability through variations in ambient temperature by the following mechanisms: (1) connecting a thermally stable resistive element in series with the electronic switch in the output current path of the electronic switch; (2) matching thermal variations of the impedance of the control signal source with thermal variations in the triggering requirements of the electronic switch; and, (3) clamping the control electrode of the electronic switch to an output electrode of the switch by means of a resistive element with a value several orders of magnitude smaller than the control-to-output resistance of the electronic switch.

Yet a further advantage of the present invention is that it provides a parallel combination of a unidirectional impedance element and a bidirectional impedance element, which combination is operative to transmit the triggering component of the control signal to the control electrode of the electronic switch while being operative to damp triggering inducing transients in the absence of the triggering component of the control signal.

An additional advantage of the present invention is that it provides a capacitor discharge ignition circuit which may be shut down by shorting the trigger coil to ground by means of a low impedance, manually operable switch. A further advantage of this shut down function is that the shorting of the trigger coil loads a common core on which the charging coil is wound thus preventing overcharging of the ignition capacitor as the engine coasts to a stop.

Yet a further advantage of the present invention is that it provides for independent variation of gate sensitivity, gate current, engine speed and SCR back bias through a design choice of values of three discrete resistors.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A capacitor discharge ignition circuit including:
a capacitor;
charging coil means for charging said capacitor;
a high voltage transformer;
a trigger coil;
an SCR for discharging said capacitor through said transformer in response to said trigger coil; and,
circuit means including a gate to cathode impedance for varying the gating sensitivity of said electronic switch, including a circuit component for varying the degree of periodic back bias on said SCR, and including a second circuit component for varying the gating current of said SCR, the variation of each of said impedance and said first and second circuit components providing substantially no variation in the response of the others thereof.

2. The capacitor discharge ignition circuit of claim 1 wherein said electronic switch in an SCR; and,
wherein said circuit means comprises:
a first resistor connecting the cathode of said SCR to the gate thereof, said first resistor providing independent variation of the SCR triggering sensitivity dependent on the value of said first resistor,
a first diode having its anode connected to the cathode of said SCR to develop a forward voltage with respect to the finish end of said trigger coil when current flows from the anode of said SCR to the cathode of said first diode, said forward voltage being sufficient to overcome a gating voltage applied to the connection between said first diode and said SCR;
a second diode having its cathode connected to the gate of said SCR and its anode connected to the start end of said trigger coil, a second resistor connected between the cathode of said SCR and the start end of said trigger coil, said second resistor providing independent variation of the gate and cathode bias of said SCR for the duration of a discharge inhibiting component of a trigger waveform dependent on the value of said second resistor, the parallel combination of a third resistor and a third diode, the anode of which third diode is connected to the cathode of said SCR, said third resistor providing suppression of extraneous voltage transients, and a fourth resistor connecting the cathode of said third diode to the finish end of said trigger coil, said fourth resistor providing independent variation of the gate current of the SCR dependent on the value of said fourth resistor.

3. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including means for protecting said SCR by limiting the voltage drop between the control and output electrodes thereof within the time interval between the substantial discharge of the capacitor and the removal of the control signal from said SCR.

4. The capacitor discharge ignition circuit of claim 3 wherein said protecting means includes diode means for limiting the voltage difference between the gate electrode of said SCR and a reference potential and between the cathode of said SCR and said reference potential.

5. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including means for inhibiting extraneous gating of said SCR by the damping of the portion of said trigger coil waveform having a conduction inducing polarity as a function of the polarity of the signal.

6. The capacitor discharge ignition circuit of claim 5 wherein said inhibiting means includes a unidirectional impedance element connected in parallel with a bidirectional impedance element.

7. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including means variable in impedance as a function of the polarity of said trigger coil waveform for selectively inhibiting the extraneous conduction of said SCR.

8. The capacitor discharge ignition circuit of claim 7 wherein said inhibiting means includes a unidirectional impedance element connected in parallel with a bidirectional impedance element.

9. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including selectively operable means for loading the core of said charge coil to thereby protect said ignition capacitor and said SCR from damage due to the continued rotation of the magnetic member in the absence of the conduction of said SCR.

10. The capacitor discharge ignition circuit of claim 9 wherein said selectively operable means includes a manually operable switch.

11. The capacitor discharge ignition circuit of claim 9 wherein said selectively operable means includes selectively short circuited coil means.

12. The capacitor discharge ignition circuit of claim 11 wherein said selectively operable means includes said trigger coil.

13. The capacitor discharge ignition circuit of claim 12 wherein said selectively operable means includes a coil selectively connected in parallel with said trigger coil.

14. A capacitor discharge ignition circuit comprising:

an ignition capacitor;

a charge coil for changing said capacitor;

a high voltage transformer;

an SCR for discharging said capacitor through said high voltage transformer;

a trigger coil for providing a trigger coil waveform;

circuit means including means for gating said SCR in response to a discharge inducing component of the trigger coil waveform and for force commutating said SCR by applying the trigger coil waveform to the SCR to induce a reverse anode-to-cathode bias, said circuit means including means for suppressing transients during the time interval in which said ignition capacitor is being charged; and, means for selecting the minimum operating engine speed for the circuit independently of the suppression of transients.

15. The capacitor discharge ignition circuit of claim 14 wherein said means for suppressing transients includes a unidirectional impedance in a parallel circuit with a bidirectional impedance; and, wherein said operating speed selecting means includes a bidirectional impedance in series with said parallel circuit.

16. The capacitor discharge ignition circuit of claim 14 wherein said trigger and shut-off coils comprise portions of a single coil wound coaxially with said charge coil.

17. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform, and;

circuit means including means for gating said SCR in response to a discharge inducing component of the trigger coil waveform and for force commutating said SCR by applying the trigger coil waveform to the SCR to induce a reverse anode-to-cathode bias, said circuit means including impedance means connected between the gate and cathode of said SCR for providing an external current path in parallel with the internal gate-to-cathode current path of the SCR, the value of said external impedance means being less than the value of the internal gate-to-cathode impedance of the SCR.

18. The capacitor discharge ignition circuit of claim 8 wherein the value of said impedance means is not less than an order of magnitude less than the internal gate-to-cathode impedance of said SCR.

19. The capacitor discharge ignition circuit of claim 18 wherein said impedance means is substantially nonresponsive to changes in temperature whereby the temperature stability of said SCR is improved.

20. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including a voltage divider network across said trigger coil with a portion of said network including a unidirectional impedance element parallel with a bidirectional impedance element.

21. The capacitor discharge ignition circuit of claim 20 wherein said circuit means further includes:

a diode connected between the gate of said SCR and ground potential;

a diode connected between the cathode of said SCR and ground potential; and a resistor connected between said gate and said cathode.

22. The capacitor discharge ignition circuit of claim 21 wherein the value of said resistor is significantly less than the internal gate-to-cathode impedance of said SCR.

23. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including selectively operable coil means for loading the core of said charge coil means and said trigger coil means.

24. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform; and, circuit means including means for gating said SCR in response to a discharge inducing component of the trigger coil waveform and for force commutating said SCR by applying the trigger coil waveform to the SCR to induce a reverse anode-to-cathode bias, said circuit means including means for shutting off the engine by selective short circuiting of said trigger coil.

25. A capacitor discharge ignition circuit comprising:

an ignition capacitor;

a charge coil for charging said capacitor;

a high voltage transformer;

an SCR for discharging said capacitor through said high voltage transformer;

a trigger coil for providing a trigger coil waveform;

a selectively operable shut-off coil, said charge, trigger and shut-off coils being wound in the same direction on a common core; and, circuit means including means for gating said SCR in response to a discharge inducing component of the trigger coil waveform and for force commutating said SCR by applying the trigger coil waveform to the SCR to induce a reverse anode-to-cathode bias.

* * * * *